US005451992A

United States Patent [19]

Shimomura et al.

[11] Patent Number: 5,451,992

[45] Date of Patent: Sep. 19, 1995

[54] INK JET HEAD HAVING AN IMPROVED INK DISCHARGE SURFACE AND INK JET APPARATUS EQUIPPED WITH THE HEAD

[75] Inventors: Akihiko Shimomura, Yokohama; Shigeo Toganoh, Tokyo; Takashi Watanabe; Akira Goto, both of Yokohama; Motoaki Sato, Tokyo, all of Japan

[73] Assignee: Canon Kabushiki Kaisha, Tokyo, Japan

[21] Appl. No.: 968,347

[22] Filed: Oct. 29, 1992

[30] Foreign Application Priority Data

Oct. 29, 1991 [JP] Japan ..... 3-283051

[51] Int. Cl.[6] ..... B41J 2/14

[52] U.S. Cl. ..... 347/45

[58] Field of Search ..... 346/140 R; 347/45

[56] References Cited

U.S. PATENT DOCUMENTS

| | | | |
|---|---|---|---|
| 3,418,302 | 12/1968 | Darby | 260/87.5 |
| 3,978,030 | 8/1976 | Resnick | 526/247 |
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/140 R |
| 4,558,333 | 12/1985 | Sugitani et al. | 346/140 R |
| 4,608,577 | 8/1986 | Hori | 346/140 R |
| 4,689,640 | 8/1987 | Shimomura | 346/140 R |
| 4,723,129 | 2/1988 | Endo et al. | 346/1.1 |
| 4,740,796 | 4/1988 | Endo et al. | 346/1.1 |
| 5,017,946 | 5/1991 | Masuda et al. | 346/140 R |
| 5,365,255 | 11/1994 | Inoue et al. | 347/45 |

FOREIGN PATENT DOCUMENTS

| | | |
|---|---|---|
| 54-56847 | 5/1979 | Japan . |
| 59-123670 | 7/1984 | Japan . |
| 59-138461 | 8/1984 | Japan . |
| 60-71260 | 4/1985 | Japan . |
| 63-122557 | 5/1988 | Japan . |
| 63-238111 | 10/1988 | Japan . |
| 63-238115 | 10/1988 | Japan . |
| 1131214 | 5/1989 | Japan . |
| 1131215 | 5/1989 | Japan . |
| 03136854 | 6/1991 | Japan . |

OTHER PUBLICATIONS

Anger, et al., "Low Surface Energy Fluoro-Epoxy Coating For Drop-On-Demand Nozzles", Jun. 93, vol. 26, No. 1, p. 431.

*Primary Examiner*—Benjamin R. Fuller
*Assistant Examiner*—Valerie Ann Lund
*Attorney, Agent, or Firm*—Fitzpatrick, Cella, Harper & Scinto

[57] ABSTRACT

An ink jet head accomplishes high quality recording for a long term by an improved liquid repellency treatment. This liquid repellency treatment is applied to at least a peripheral portion of a discharge port on an ink discharge port forming surface of the ink jet head. A mixture of a fluorine-containing high polymer compound and a compound having fluorine substituted hydrocarbon group and a silazane group, alkoxysilane group or halogenized silane group is employed as a liquid repellent agent.

6 Claims, 3 Drawing Sheets

INK JET HEAD HAVING AN IMPROVED INK DISCHARGE SURFACE AND INK JET APPARATUS EQUIPPED WITH THE HEAD

BACKGROUND OF THE INVENTION

1. Field of the Invention

This invention relates to a recording head for forming flying small droplets by discharging a recording liquid generally called ink from a discharge port, and more particularly to an ink jet recording head where water repellency is improved for a peripheral portion of the discharge port.

2. Related Background Art

FIG. 1 is a perspective development illustrating a structure of a conventional ink jet recording head. This recording head is provided with a discharging pressure generating element 12 located on a substrate 11 made of glass, ceramics or the like. By patterning a photo-sensitive resin cured film 13 by a photolithography method, there are formed a liquid pathway 15 corresponding to the discharging pressure generating element 12, a discharge port 14, and a liquid chamber 16. On the photosensitive resin cured film 13, there is secured by a bonding agent 19 a top plate 17 made of, for example, glass, ceramics, metal or the like. The top plate 17 is formed with a recording liquid supply port 18.

In the recording head constructed as described above, the physical properties of the substrate 11 around the discharge port 14, the photo-sensitive resin cured film 13, and the surface of the top plate 17 are extremely important for constant and stable discharge of the recording liquid from the discharge port 14. More specifically, if the recording liquid invades around the periphery of the discharge port 14 to cause a liquid pool in part thereof, this liquid pool affects the recording liquid in the pathway 15 such that the flying direction of the recording liquid, when discharged from the discharge port, deviates from a predetermined normal direction. Further, due to an unstable state of the liquid pool, the flying direction of liquid droplets is disturbed every time they are discharged, thereby hindering stable liquid discharge and accordingly satisfactory recording.

Furthermore, a so-called splash phenomenon, i.e., the entire periphery of the discharge port 14 is covered with a recording liquid film may arise to cause scattering of the recording liquid, which leads to hindering stable recording. Also, when a liquid pool covering a peripheral portion of the port becomes larger, the recording head even falls into a liquid discharge disabled condition.

The members surrounding the discharge port of the recording head as shown in FIG. 1 are in many cases made of different materials from each other. For example, the substrate 11 is made of silicon; the top plate 17 is made of glass; and the photo-sensitive resin cured film 13 is made of resin. The recording liquid is most likely to leak from a portion made of the most susceptible material to leakage of the three kinds of materials used in the peripheral portion of the discharge port. Among these three kinds of materials, glass is most susceptible to leakage of normal ink, so that ink possibly leaks from a portion made of glass. However, the glass is generally used because of its favorable properties suitable to the production of heads, so that substitution of another material for glass for the purpose of preventing leakage of ink is not desirable in view of production, performance and cost-effect of the recording head.

To solve the problem that a liquid pool of a recording liquid in a peripheral portion of a discharge port hinders the recording liquid from being stably discharged, as described above, conventional recording heads have the peripheral portion of the discharge port 14 subjected to a so-called liquid repellency treatment to form a liquid repellency treated layer 20 which sheds ink. A number of proposals for solving the above-mentioned problem by this water repellency treatment have already been open to the public. As agents used for this liquid repellency treatment, there are a variety of materials, for example, silicon-group polymer and oligomer, fluorine-group polymer and oligomer, and so on.

The liquid repellency treated layer 20 formed on an ink jet recording head must have not only favorable water repellency but also sufficient durability. The durability of such liquid repellency treated layer will hereinafter be discussed.

For implementing an ink jet recording method, even with a liquid repellency treated peripheral portion of a discharge port, the peripheral portion of the discharge port is always in contact with a recording liquid, so that a recovery operation is generally performed such that the discharge port surface is wiped by an absorbing member made of polyurethane foam or the like to remove ink attached thereon. Therefore, the water repellency treated layer is required to have adhesive property and wear resistance to an extent that it is not peeled or destroyed, even if wiped by an absorbing member. If these properties are not sufficient, even if initial performance and effects may be satisfactory, the water repellency treated layer will be gradually peeled, destroyed, or present no water repellency effects while a recording head is being used for a long term, which leads to hindering a stable discharging operation for printing. There have been found several cases where a water repellency treated layer formed by a conventional water repellency treating agent is not sufficient for the durability required to such an ink jet recording head. Specifically, referring to FIGS. 3A–3C, consider a case where a rubber blade is used to remove ink and foreign substances attached on a dischare port surface. When a relatively soft fluorine compound of a conventional type is used as a water repellency treating agent, fragments of a layer made of the water repellency treating agent, scraped off by the rubber blade or the like (FIG. 3A), invade even into the discharge port of the recording head (FIG. 3B). If the scraped water repellency treating agent fragments invade into the discharge port, the meniscus position of ink is offset (FIG. 3C), thereby giving rise to slippage and consequently deteriorating the quality of printed characters. For this reason, there has been a need to a water repellency treated film which is highly resistant to wiping by a rubber blade or the like and has a high hardness.

With an ink jet recording head which has members around a discharge port made of a plurality of different materials, it is necessary to form a liquid repellency treated layer which exhibits a good adhesive property with all materials. Liquid repellency treated layers formed by conventional liquid repellency treating agents are sometimes insufficient particularly in this respect. On the other hand, with an ink jet recording head employing a groved top plate having a liquid chamber, a liquid pathway and a discharge port surface integrally formed therein, the grooved top plate is made of a single material since it is molded. Even if a top plate is made of a single material, such a material must be selected in many cases from a limited number of materials due to restraints such as the properties thereof associated with easiness in molding, ink contact property and so on. While materials such as polysulfone, polyethersulfone and so on are generally employed, many of these materials do not have a functional group reactive with other materials, thereby the adhesive property with the liquid repellency treating agent is not sufficient, thereby incurring problems of peel-off of the liquid repellency treated layer.

Even if wear resistance is ensured by using a high polymer liquid repellency treated layer with a relatively high hardness sufficient adhesive property is not provided, which may occasionally result in the liquid repellency treated layer peeled from a peripheral portion of a discharge port as shown in FIGS. 4A, 4B. Furthermore, when the liquid repellency treatment is performed with a high polymer liquid repellent agent with a high hardness after forming a discharge port, liquid repellency treated layer is sometimes formed in a manner that it covers the discharge port due to its good film forming property. Even if a so-called silane coupling agent is mixed with a high polymer liquid repellent agent to compensate for lack of adhesive property, the liquid repellency is degraded when it is in use.

SUMMARY OF THE INVENTION

The present invention has been made to solve the above problems, and its object is to improve the adhesive property of a liquid repellent agent to base materials of a head structure.

It is another object of the present invention to enable high quality recording for a long term by treating a head to impart thereto a good liquid repellency with a high durability.

It is a further object of the present invention to provide an ink jet head, wherein a liquid repellency treatment is applied to at least a peripheral portion of the discharge port on an ink discharge port forming surface with a mixture of a fluorine-containing high polymer compound and a compound having fluorine substituted hydrocarbon group and a silazane group, alkoxysilane group or halogenized silane group.

It is a yet further object of the present invention to provide an ink jet apparatus having:

- an ink jet head, wherein a liquid repellency treatment is applied to at least a peripheral portion of the discharge port on an ink discharge port forming surface with a mixture of a fluorine-containing high polymer compound and a compound having fluorine substituted hydrocarbon group and a silazane group, alkoxysilane group or halogenized silane group;
- a supporting member on which the ink jet recording head is mountable; and
- a cleaning member for sliding on the discharge port surface of the head at a predetermined timing to remove substances attached on the discharge port surface.

According to the present invention, by performing a liquid repellency treatment for at least a peripheral portion of a discharge port with a mixture of fluorine-containing high polymer compound, fluorine substituted hydrocarbon group and a compound having a silazane group, alkoxysilane group or halogenated silane group, the adhesive property of a liquid repellency treated layer to base materials of the head and a long-term adhesion durability are largely improved as compared with conventional liquid repellent agents.

In the present invention, since the solution of the problem is related only to the vicinity of the discharge port, a portion including the discharge port of the recording head alone will hereinafter be particularly pointed out and described in detail. However, it should be understood that the present invention is not necessarily limited to a recording head as shown in FIG. 2 but can be applied to any type of recording head which discharges a liquid from discharge port as long as it complies with the gist of the present invention. The present invention is applicable not only to a recording head of the type as shown in FIG. 2 where an end portion of a pathway forms a discharge port but also to a recording head of a type which is provided with a discharge port surface for forming a discharge port separately from a pathway formed with a hole of a predetermined diameter in an end portion thereof.

DETAILED DESCRIPTION OF THE PREFERRED EMBODIMENTS

Figure 5:
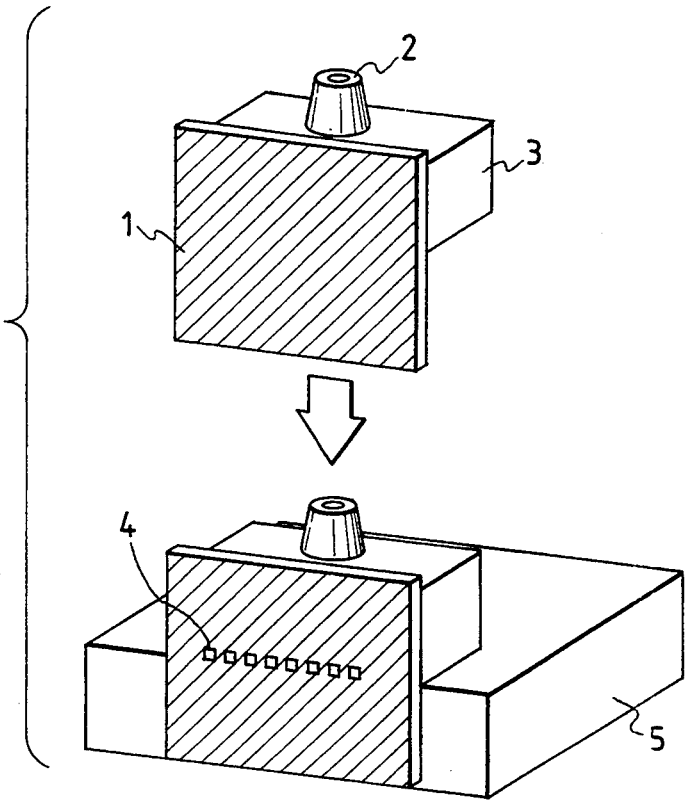
FIG. 5 is a diagram illustrating a recording head which was subjected to a liquid repellency treatment according to the present invention.

FIG. 5 illustrates a top plate 3 having grooves (not shown) according to one embodiment of the present invention in which a liquid chamber, liquid pathways and a discharge port surface are integrally molded. When the discharge port surface of the top plate 3 is subjected to a liquid repellent treating agent and thereafter thermally cured, a liquid repellent film 1 is formed. Then, the liquid repellent film 1 is bonded to the top plate 3 with grooves (not shown) having a discharge port formed therein by perforation effected by means of an excimer laser or the like and a substrate 5 having a heat generating member constituting a means for discharging ink from the discharging port.

The present invention treats the outer surface of an ink jet recording head surrounding the discharge port with a compound especially provided by the present invention to impart liquid repellency whereby stable ink jet recording can be maintained forever.

A fluorine-containing hetero ring structure in the present invention refers to the structure of an organic compound of five-to-eight membered ring including one to two hetero atoms in the chemical structure formula. The hetero atom refers to atoms other than carbon. Specifically, oxygen, nitrogen, sulfur, phosphor and so on are employed as the hetero atom. Particularly, oxygen is preferably employed from viewpoints of chemical stability and safety. In the present invention, a fluorine-containing polymer includes not less than 10 weight percent (wt %), preferably 25 wt % or more, and more preferably 50 wt % of fluorine content, in view of the liquid repellency (contact angle). Also, the proportion of the ring structure in a main chain should be 10 percent or more, preferably 20 percent or more, and more preferably 30 percent or more, in view of the strength of a layer to be formed, the solubility to a solvent, the adhesive property with the substrate and so on.

In the present invention, it is preferable to employ an amorphous polymer among a variety of fluorine-containing polymers having the hetero ring structure. This is because the amorphous polymer is so excellent in,film strength, adhesive property to the substrate, uniformity of film and so on that more effects of the present invention can be produced by employing the amorphous polymer to the liquid repellent film.

As fluorine-containing polymers having the hetero ring structure in a main chain, polymers described, for example, in U.S. Pat. Nos. 3,418,302 and 3,978,030 and Japanese Laid-Open Patent Application Nos. 63-238111, 63-238115, 1-131214, 1-131215 and so on may be preferably employed in the present invention.

Within the above referred polymers, those having the following hereto ring structures are typical. However, it should be understood that the present invention is not limited to them:

(1)

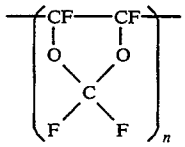

(2)

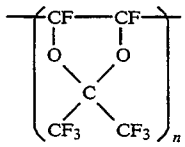

(3)

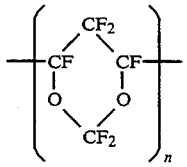

(4)

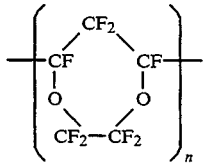

(5)

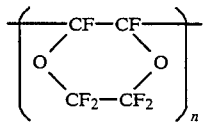

-continued (6)

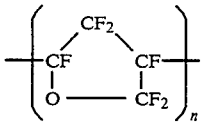

(7)

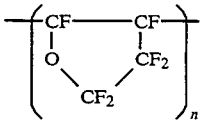

(8)

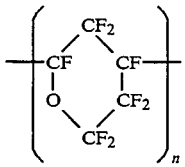

Further, for improving the adhesive property with the substrate, Tg, and controlling the solubility to a solvent, the following structure may be introduced into the main chain:

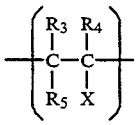

where $R_3$, $R_4$ and $R_5$ each represent H, F, Cl or Rf (fluorine containing alkyl group), and X represents H, F, Cl, $Rf_3$ or $Rf_4$. $Rf_3$ represents a fluorine-containing organic substitution group having a function group such as acid, ester, alcohol, amine, amid or the like at an end thereof, and $Rf_4$ represents fluorine-containing alkyl group or fluorine-containing ether. These structures are obtained by copolymerizing with the following comonomers.

$CF_2=CF—O—CF_2CF(CF_3)—O—CF_2CF_2SO_2F$;

$CF_2=CF—O—CF_2CF_2CF_2COOCH_3$; and $CF_2=CF—CF_2CF(CF_3)—O—CF_2CF_2SO_2F$

As materials having particular chemical structures as shown above and appropriate to liquid repellency treating agents, there are Citop CTX-105 (product name, made by Asahi Glass), Citop CTX-805 (product name, made by Asahi Glass), and Teflon AF (product name, made by Dupont).

A compound having a fluorine substituted hydrocarbon group and a silazane group according to the present invention is expressed by the following formula (I) or (II):

$$R—Si(NH_2)_3 \quad (I)$$

$$R—Si(NH_2)_2—NH—Si(NH_2)_2—R' \quad (II)$$

Note that R and R' in the formulae (I) and (II) each represent a hydrocarbon group where one or more hydrogen atoms are substituted by fluorine, and R and R' may be the same or different from each other. As a material having the particular chemical structure as shown above and appropriate to a treating agent for the present invention, there is KP801 (product name, made by Shinetsu Chemical Co., Ltd.)

Next, compounds having a fluorine substituted hydrocarbon group and an alkoxysilane group or a halogenized silane groups are those having an alkoxysilane group or a halogenized silane group expressed by the following ordinary formulae (III) and (IV):

$$-Si(OR_I)_nR_{II(3-n)} \quad \text{(III)}$$

$$-SiX_mR_{III(3-m)} \quad \text{(IV)}$$

where n and m are positive integer numbers not more than three.

In the above formulae, $R_I$ and $R_{II}$ each represent an alkyl group (for example, methyl group ethyl group, propyl group, butyl group or the like) or an alkoxy group (for example, methoxy group, ethoxy group, buthoxy group or the like). X represents a halogen atom (for example, Cl, Br, I). Further, when two or more $R_I$, $R_{II}$, $R_{III}$ or X are coupled to Si, the chemical structure may vary within the groups and atoms shown above. For example, two $R_{III}$'s may be different, e.g., one is an alkyl group and the other is an alkoxy group. Particularly, the fluorine substituted hydrocarbon group preferably has a perfluoro group such as a $CF_3(CF_2)_a$ — group, $(CF_3)_2CF(CF_2)_a$— group or the like at one end of the molecular structure, where a or a' is a positive integer number.

As materials having the particular chemical structure as shown above and appropriate to the treating agent for the present invention, there are FS116 (product name, made by Daikin Industry), LP8T, KP8FT (product names, made by Shinetsu Chemical Co., Ltd.)

In the present invention, liquid repellent film forming methods may be generally classified into two according to the difference in a head forming process.

Figure 1:
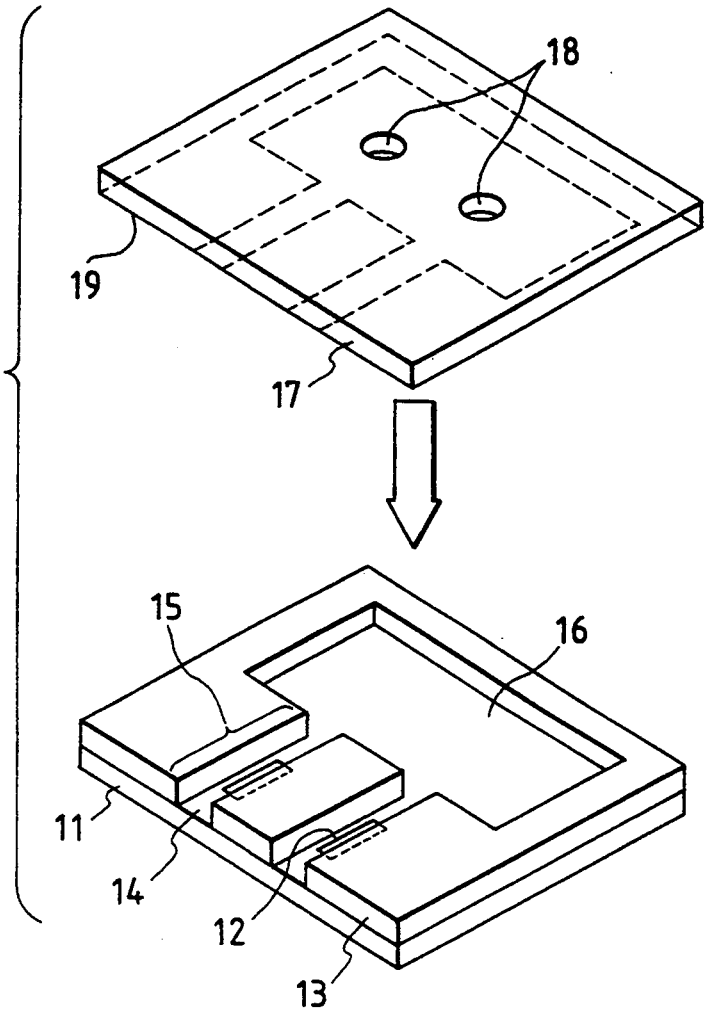
FIG. 1 PRIOR ART
FIG. 1 is a schematic explanatory diagram illustrating a typical example of an ink jet recording head.
Figure 2:
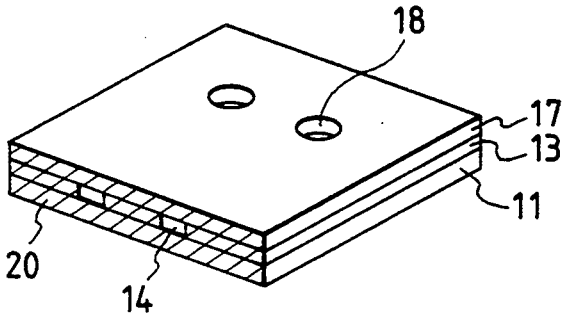
FIG. 2 PRIOR ART
FIG. 2 is a perspective view illustrating the appearance of a multi-type recording head which was subjected to a liquid repellency treatment.
Figure 3A:
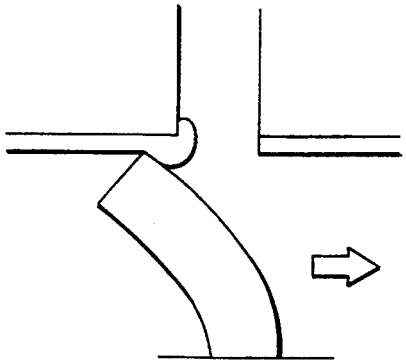
FIG. 3A PRIOR ART
FIGS. 3A–3C are schematic explanatory diagrams illustrating the influence exerted by a liquid repellency treated film which is scraped by a rubber blade and invades into a discharge port.
Figure 3B:
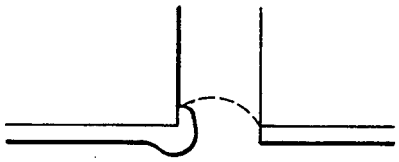
FIG. 3B PRIOR ART
Figure 3C:
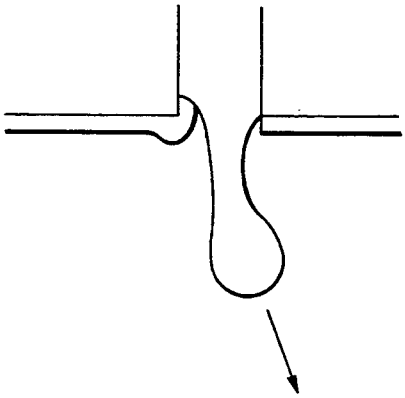
FIG. 3C PRIOR ART
Figure 4A:
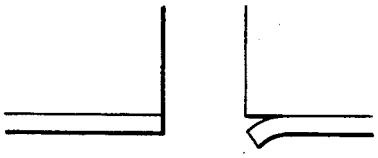
FIGS. 4A and 4B are schematic explanatory diagrams respectively illustrating a state where a liquid repellency treated film is peeled.
Figure 4B:
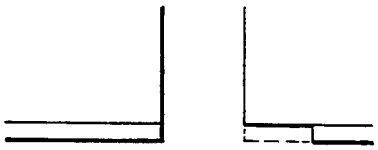

Specifically, there are a type which forms a discharge port after forming a liquid repellent film as shown in FIG. 5, and a type which forms a liquid repellent film after forming a discharge port as shown in FIG. 1. In the former type, the liquid repellent film can be formed on the periphery of the discharge port by immersion in stock solution or diluent of polymer having the particular ring structure as proposed by the present invention, transfer by means of an absorbing member or the like, or an ordinary coating method such as spray coating or spin coating. In the latter type, since the methods indicated above cause a liquid repellent agent to invade through the discharge port into the inner wall surface of the ink pathway, countermeasures for preventing this are required. For example, silicon rubber or the like is employed to transfer the liquid repellent film, the ink pathway is previously filled with a liquid which does not mix with the liquid repellent agent or with a solid, the liquid repellency treatment is performed while air is blown out from nozzles, and so on.

While a solvent to be used is not particularly limited as long as it solves the polymer of the present invention, perfluorobenzene, "afludo" (product name: a fluorine solvent made by Asahi Glass), "florinato" (product name: a liquid including perfluoro (2-butyltetrahydrofuran) made by 3M) are preferable. In the case of a mixed solvent, hydrocarbon, chlorinated hydrocarbon, fluorine chlorinated hydrocarbon, alcohol, and other organic solvents may be used together.

(Embodiment 1)

The grooved top plate shown in FIG. 5 was first washed. Then, an absorbing member made of beruita.F mesh (made by Kanebou) is cut in a predetermined size, immersed in a liquid repellency treating agent, and pulled up. Then, the thus prepared absorbing member is moved on the port surface of the washed grooved top plate with pressure, thereby coating the liquid repellency treating agent on the port surface.

As the liquid repellency treating agent, Citop CTX-105 (made by Asahi Glass, a solvent including 5 wt % of resin) and KP801 (made by Shinetsu Chemical Co., Ltd, a solvent including 3 wt % of nonvolatile components) were equivalently mixed and diluted with CT-solve 100 (made by Asahi Glass) so as to include 0.5 wt % of nonvolatile components.

The grooved top plate after the coating had been completed was placed on a tray, left in an oven at a temperature of 150° C. for one hour for thermal drying and curing. After one hour, it was gradually cooled, and taken out of the oven when the temperature fell below 80° C. After completing the liquid repellency treatment, a discharge port was formed in the grooved top plate by an excimer laser or the like. Then, the grooved top plate was bonded to a substrate having a discharging pressure generating element.

(Embodiment 2)

Similarly to Embodiment 1, after washing the grooved top plate, a liquid repellency treating agent was coated thereon using a similar absorbing member. The used liquid repellency treating agent was one which was made by equivalently mixing AF1600 (Teflon AF, product name, made by Dupont) and KP8FT (a solvent including 3 wt % of nonvolatile components made by Shinetsu Chemical Co., Ltd. ) and diluting the mixture with Florinato FC-75 (product name, made by 3M) so as to include 0.5 wt % of nonvolatile components.

The grooved top plate, after the coating had been completed, was placed in a tray and left in an oven at a temperature of 150° C. for one hour for thermal drying and curing. After one hour, it was gradually cooled, and taken out of the oven when the temperature fell below 80° C.

After completing the liquid repellency treatment, a discharge port was formed in the grooved top plate by an excimer laser or the like. Then, the grooved top plate was bonded to a substrate having a discharging pressure generating element.

(Embodiment 3)

Explanation will be given of a case where the liquid repellency treatment is performed on a recording head which has a discharge port previously formed therein.

First, a multi-nozzle head as shown in FIG. 1 was produced. Then, the outer wall surface of the discharge port was well washed.

As a liquid repellency treating agent, Citop CTX-105 (product name, made by Asahi Glass) and KP801 (made by Shinetsu Chemical Co., Ltd. ) were equivalently mixed and diluted with CT-solve 100 (made by Asahi Glass) so as to include 0.1 wt % of nonvolatile components.

Silicon rubber was placed on a spinner, and two cc of the above prepared liquid was dropped on the silicon rubber. After the dropping, the silicon rubber was rotated on the spinner to form a uniform film. The rotational speed and rotating time were respectively set at 1000 rpm and five seconds for a first case and at 3000 rpm and 20 seconds for a second case. Then, the discharge port surface of the multi-nozzle head was urged on this silicon rubber such that the film was transferred onto the discharge port surface. This process was repeated three times, and the urging pressure was 2 kg/head.

After the transfer had been completed, each head was left in an oven at 150° C. for one hour for thermal drying and curing. As a liquid repellency treating agent, a combination of AF1600 and KP8FT can also be transferred under similar conditions. Incidentally, while an applicable concentration of the liquid repellency treating agent ranges approximately from 0.01 wt % to 10 wt %, if the concentration is selected between 0.05 wt % and 2 wt %, a required number of transfer is reduced and a favorable liquid repellent film can be formed.

(Comparative Example 1)

The completely same operation as Embodiment 1 was performed while the liquid repellency treating agent was replaced by single Citop CTX-105 (product name, made by Asahi Glass) diluted with CT-solve 100 (made by Asahi Glass) so as to include 0.5 wt % of nonvolatile components.

(Comparative Example 2)

The completely same operation as Embodiment 3 was performed while the liquid repellency treating agent was replaced by single Citop CTX-805 (product name, made by Asahi Glass) diluted with CT-solve 180 (made by Asahi Glass) so as to include 0.1 wt % of nonvolatile components.

(Comparative Example 3)

The completely same operation as Embodiment 3 was performed while the liquid repellency treating agent was replaced by a mixture prepared by mixing Citop CTX-805 (product name, made by Asahi Glass) and NUC silane coupling agent A-1110 (product name, made by-Japan Unicar) in the ratio of four to one and diluting the mixture with CT-solve 180 (made by Asahi Glass) so as to include 0.1 wt% of nonvolatile components.

Next, for examining the performance of the liquid repellency of the ink jet recording head which had been treated with the particular liquid repellent agents of the present invention, the liquid repellency was evaluated with respect to the coating property to the substrate, initial characteristic, durability and so on. The contents of the evaluation are as follows:

[Evaluation Contents]

(1) Coating/transfer property→Presence or absence of defects in coating/transfer (2) Initial characteristics→Initial contact angles (advanced and retrogressed) adhesive property (presence or absence of a peeled portion in a peel test)

(3) Durability→Wear resistance (change in the advanced and retrogressed contact angles after a test) →Ink immerse test (change in the advanced and retrogressed contact angles)

TABLE 1

[Evaluation Results]

| | | Initial Characteristics | | Durability | |
|---|---|---|---|---|---|
| | Coating/Transfer Property | Contact Angle | Adhesive Property | Abrasion Resistance | Ink Immersion |
| Embodiment 1 | ◎ | ○ | ◎ | ○ | ◎ |
| Embodiment 2 | ◎ | ○ | ◎ | ○ | ◎ |
| Embodiment 3 | ◎ | ○ | ◎ | ○ | ◎ |
| Comparative Example 1 | Δ (Bad yield) | ◎ | ○ | ○ | ○ |
| Comparative Example 2 | Δ (Bad yield) | ◎ | ○ | ○ | ○ |
| Comparative Example 3 | ◎ | Δ | ◎ | ○ | ◎ |

In the table, ◎ indicates excellent results, ○ sufficient performance, and Δ unfavorable condition.

As described above, the compounds provided by the present invention, when used for the liquid repellency treatment, readily obtain a recording head which stably discharges a substantially uniform amount of liquid always in a predetermined direction and furthermore is sufficiently applicable to high speed recording.

Next, description will be made on the mechanism of the improvement in adhesive property of the compounds of the present invention to a substrate.

Generally, fluorine-containing high polymer compounds are considered to be excellent in both liquid repellency and film forming property. Conversely, due to its low surface free energy, it is said that the adhesive property to a substrate is relatively low. As a general and simple method for improving the adhesive property, there is a method of adding a so-called silane coupling agent to a liquid repellency treating agent, which, however, results in degrading the essential liquid repellency. However, the compounds of the present invention can improve the adhesive property without causing such degradation of the liquid repellency.

Conventionally, when a liquid repellency treated film was coated by a transfer method, fluorine-containing compound alone caused in many cases defects during the transfer due to its high film forming property. However, the compounds of the present invention exhibit improved coating/transfer property.

The present invention produces remarkable effects in an ink jet recording system, and particularly, in a recording head and a recording apparatus of such an ink jet recording system which utilizes thermal energy to form flying droplets for recording.

The typical structure and principle of this type of ink jet recording system are disclosed in for example, the specifications of U.S. Pat. Nos. 4,723,129 and 4,749,796, and it is preferable that the present invention employ the basic principle described therein. This recording system is applicable to either of so-called on-demand type and continuous type.

Explaining briefly this recording system, an electrothermal transducer arranged corresponding to a sheet and a liquid pathway, in which ink is held, is applied with at least one driving signal corresponding to recording information for giving a rapid temperature rise to a liquid (ink) to exceed nuclear boiling and cause film boiling, whereby thermal energy is generated to cause film boiling on a heat acting face of a recording head. This recording system is particularly effective to an the on-demand type recording method since bubbles can be formed from the liquid (ink) corresponding one by one to the driving signals applied to the electro-thermal transducer. The ink is discharged from a discharge port by the action of growth and contraction of bubbles to form at least one droplet. It is preferable that a pulse signal is used as the driving signal because the growth and contraction of bubbles are immediately and properly performed by such a pulse-shaped driving signal, whereby particularly excellent ink discharge can be achieved. As this pulse-shaped driving signal, those described in the specifications of U.S. Pat. Nos. 4,463,359 and 4,345,262 are suitable. Further, if conditions described in the specification of U.S. Pat. No. 4,313,124 concerning a temperature rising ratio on the heat acting face are employed, further excellent recording can be achieved.

It should be noted that the structure of the recording head according to the present invention includes such one that employs structures described in the specifications of U.S. Pat. Nos. 4,558,333 and 4,459,600 each of which discloses a structure in which a heat acting portion is arranged in a bent region, in addition to a combined structure (a straight flow pathway or a perpendicular flow pathway) formed of a discharge port, a liquid pathway and an electro-thermal transducer as disclosed in the above-mentioned respective specifications.

Additionally, the present invention is also effective when the recording head is constructed on the basis of Japanese Laid-Open Patent Application No. 59-123670 which discloses a structure where common slits serve as discharge ports for a plurality of electro-thermal transducers and Japanese Laid-Open Patent Application No. 59-138461 which discloses a structure where an opening for absorbing pressure wave of thermal energy is arranged corresponding to a discharging section.

The present invention is also applicable to a recording head of full line type which has a length corresponding to the width of the widest recording medium on which a recording apparatus can record. This full line head may be constituted by either a plurality of recording heads assembled so as to extend over the full line length or a single integrated full-line recording head.

Additionally, the present invention may also employ an exchangeable chip-type recording head to which electric connection with the recording apparatus and ink supply from the recording apparatus can be achieved by mounting the head in the recording apparatus, or a cartridge type recording head which has an ink tank integrated therewith.

Also, the addition of a recovering means for a recording head, a preparatory supporting means and so on, which may be provided as constituents of the recording apparatus of the present invention, is preferable since the effect of the present invention can be further stabilized by these means. Specifically, these means may be a capping means; a cleaning means; a pressurizing or sucking means; and a preparatory heating means comprising an electro-thermal transducer or an alternative heating element, or a combination of these two elements. It is also effective for stable recording to add a means for performing a preparatory discharging mode which executes other discharging than that for the recording purpose.

Further, as a recording modes of the recording apparatus, the present invention is extremely effective for use in such apparatus which have a single mode of recording in a main color such as black as well as those which are provided with at least one of a plural color recording mode using different colors and a full color recording mode utilizing mixture of different colors by means of an integrally structured recording head or a combination of a plurality of recording heads.

In the foregoing embodiments of the present invention, although the ink was explained as a liquid, the ink may be such one that is solidified at temperatures less than room temperatures and softened or liquified at room temperatures. Alternatively, since the ink jet recording apparatus generally controls the temperature of ink in a range between 30° C. and 70° C. to maintain the viscosity of the ink in a stably dischargeable state, any ink may be used as long as it is in a liquid state when a recording signal is supplied.

Further, it is possible to employ ink, which is solid in an unused state, for the purpose of preventing an excessive temperature rise of ink or preventing the ink from evaporating due to thermal energy, by positively utilizing the thermal energy to change the ink from a solid state to a liquid state. After all, the present invention is applicable to the use of ink having the characteristics of being liquified only by applying thermal energy there to, e.g., ink which is liquified and discharged by applying thereto thermal energy in response to a recording signal; ink which has already begun solidifying when reaching a recording medium; and so on.

The ink for these cases may be such one that is stored in liquid or solid state within cavities or through-holes of a porous sheet in a cartridge, and the cartridge is placed opposite to an electro-thermal transducer, as described in Japanese Patent Laid-Open Application Nos. 54-56847 or 60-71260.

In the present invention, the most effective apparatus for the above-mentioned respective ink is the one which executes the foregoing film boiling method.

Figure 6:
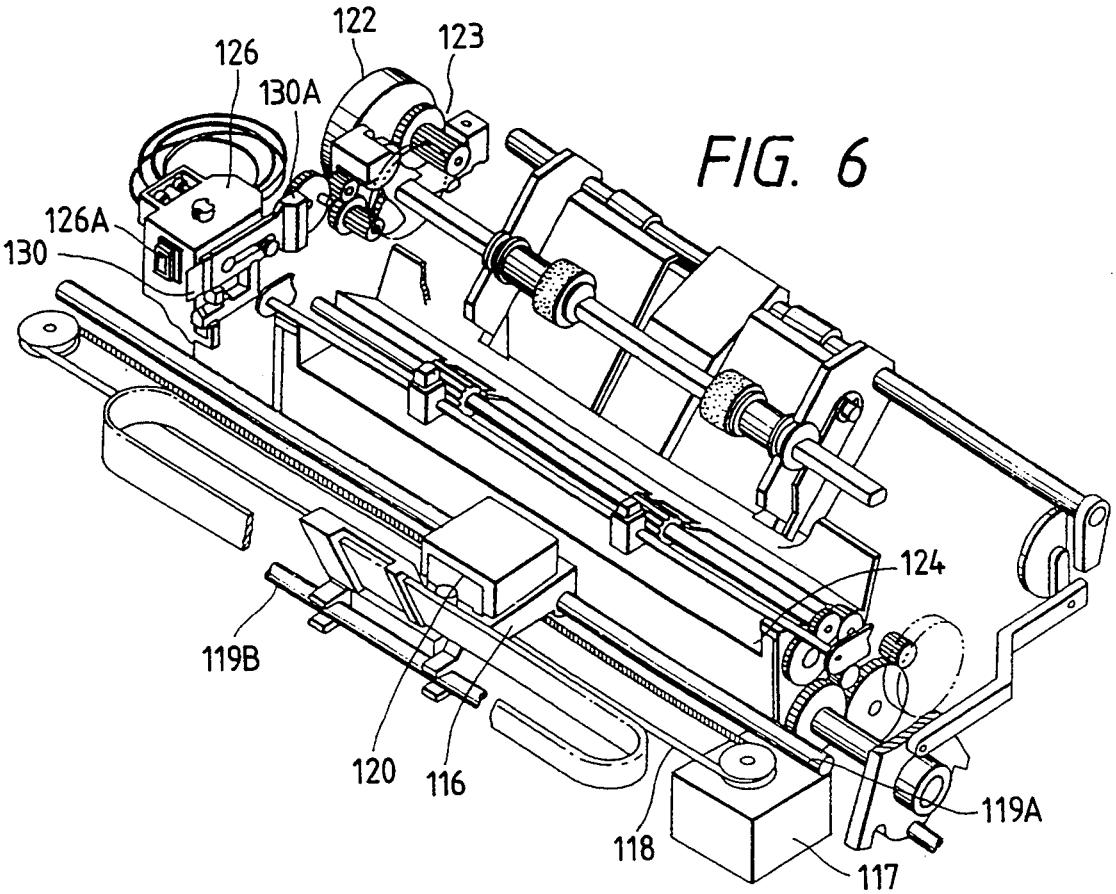
FIG. 6 is a perspective view illustrating the appearance of an ink jet apparatus which is equipped with the recording head of the invention.

FIG. 6 is a perspective view illustrating the appearance of an exemplary ink jet recording apparatus (IJRA) in which the recording head provided by the present invention is mounted as an ink jet head cartridge (IJC).

In the drawing, an ink jet head cartridge (hereinafter referred to as "the IJC") 120 is provided with a group of nozzles for discharging ink onto a recording face of a recording medium fed on a platen 124. A carriage HC 116, which carries the IJC 120, is coupled to part of a driving belt 118 for transmitting a driving force of a driving motor 117 and is made slidable on two guide shafts 119A and 19B arranged in parallel to each other, whereby the IJC 120 can reciprocally move over the whole width of the recording medium.

A head recovering device 126 is arranged at an end of a moving path of the IJC 120, for example, at a position opposite to a home position of the IJC 120. The head recovering device 126 is operated by a driving force of a motor 123 through a transmission mechanism 123 to perform capping of the IJC 120. In association with the capping of the IJC 120 by a cap 126A of the head recovering device 126, ink is sucked by an appropriate sucking means arranged in the head recovering device 126, or ink is delivered by a pressure developed by an appropriate pressurizing means arranged in an ink supply pathway to the IJC 120 to forcibly discharge ink through a discharge port, whereby a discharging recovery operation is performed for removing viscosity increased ink in the nozzles. Upon completion of the recording, the IJC 120 is capped for protection.

A blade 130 arranged on a side face of the head recovering device 126, is a wiping member constituted of silicon rubber. The blade 130 is held by a blade holding member 130A in a cantilever manner and operated by the motor 122 and the transmission mechanism 123, similarly to the head recovering device 126, such that the blade 130 can be engaged with the discharge surface of the IJC 120. The blade 130 is thus projected in the moving pathway of the IJC 120, at an appropriate timing during a recording operation of the IJC 120 or after a discharging recovery operation by the use of the head recovering device 126, to wipe out dew, leaking ink, dust and so on the discharge surface of the IJC 120, with the movement of the IJC 120.

Among a variety of currently known recording systems, the so-called ink jet recording method is in general recognized to be an extremely useful recording method since this is a non-impact recording method which generates little noise during recording, realizes high speed recording and allows recording to be performed on normal paper without requiring special fixing processing.

What is claimed is:

1. An ink jet head comprising an ink discharge port for discharging ink, wherein a liquid repellency treatment is applied to at least a peripheral portion of said discharge port on an ink discharge port forming surface with a mixture of (i) a fluorine-containing polymer having a hetero ring structure and (ii) a compound having a fluorine substituted hydrocarbon group and a group selected from the group consisting of a silazane group, an alkoxysilane group or a halogenized silane group.

2. An ink jet head according to claim 1, wherein said fluorine-containing polymer having a hetero ring structure contains at least 10% by weight of fluorine.

3. An ink jet head according to claim 1, wherein said fluorine-containing polymer having a hetero ring structure is an amorphous polymer.

4. An ink jet apparatus comprising:

an ink jet recording head, wherein a liquid repellency treatment is applied to at least a peripheral portion of said discharge port on an ink discharge port forming surface with a mixture of (i) a fluorine-containing polymer having a hetero ring structure and (ii) a compound having a fluorine substituted hydrocarbon group and a group selected from the group consisting of a silazane group, an alkoxysilane group or a halogenized silane group;

a supporting member on which said ink jet recording head is mountable; and a cleaning member for sliding on the discharge port surface of said head at a predetermined timing to remove a substance attached on the discharge port surface.

5. An ink jet apparatus according to claim 4, wherein said fluorine-containing polymer having a hetero ring structure contains at least 10% by weight of fluorine.

6. An ink jet apparatus according to claim 4, wherein said fluorine-containing polymer having a hetero ring structure is an amorphous polymer.

* * * * *

UNITED STATES PATENT AND TRADEMARK OFFICE

CERTIFICATE OF CORRECTION

PATENT NO. : 5,451,992

DATED : September 19, 1995

INVENTOR(S) : AKIHIKO SHIMOMURA, ET AL.

It is certified that error appears in the above-identified patent and that said Letters Patent is hereby corrected as shown below:

ON TITLE PAGE

In [56] References Cited, under FOREIGN PATENT DOCUMENTS:

```
        " 1131214  5/1989  Japan
          1131215  5/1989  Japan
         03136854  6/1991  Japan "   should read

       -- 1-131214  5/1989  Japan
          1-131215  5/1989  Japan
          3-136854  6/1991  Japan --.
```

COLUMN 1

Line 48, "film" should read --film,--.

COLUMN 2

Line 2, "cost-effect" should read --cost--.
Line 55, "to" should read --for--.
Line 66, "groved" should read --grooved--.

COLUMN 4

Line 31, "into" should be deleted.
Line 53, "port" should read --port 4--.

COLUMN 5

Line 16, "in,film" should read --in film--.

UNITED STATES PATENT AND TRADEMARK OFFICE

CERTIFICATE OF CORRECTION

PATENT NO. : 5,451,992

DATED : September 19, 1995

INVENTOR(S) : AKIHIKO SHIMOMURA, ET AL.

It is certified that error appears in the above-identified patent and that said Letters Patent is hereby corrected as shown below:

COLUMN 7

Line 20, "buthoxy" should read --butoxy--.

COLUMN 9

Line 33, "a" should read --the-- and
"transfer" should read --transfers--.
Line 37, "completely" should read --exact--.
Line 45, "completely" should read --exact--.
Line 53, "completely" should read --exact--.

COLUMN 10

Line 60, "4,749,796" should read --4,740,796--.

COLUMN 11

Line 5, "to an" should read --with--.

COLUMN 12

Line 3, "a" should read --for--.
Line 29, "there" should read --there- --.

UNITED STATES PATENT AND TRADEMARK OFFICE

CERTIFICATE OF CORRECTION

PATENT NO. : 5,451,992

DATED : September 19, 1995

INVENTOR(S) : AKIHIKO SHIMOMURA, ET AL.

It is certified that error appears in the above-identified patent and that said Letters Patent is hereby corrected as shown below:

COLUMN 12

Line 55, "19B" should read --119B--.

Signed and Sealed this

Fifth Day of March, 1996

Bruce Lehman

*Attest:*

BRUCE LEHMAN

*Attesting Officer*

*Commissioner of Patents and Trademarks*